US009181814B2

(12) United States Patent
Rowley et al.

(10) Patent No.: US 9,181,814 B2
(45) Date of Patent: Nov. 10, 2015

(54) TURBINE ENGINE COMPRESSOR STATOR

(75) Inventors: Hope C. Rowley, York, ME (US); Paul W. Baumann, Amesbury, MA (US); Edwin M. Worth, Northville, MI (US); Carl S. Richardson, South Berwick, ME (US)

(73) Assignee: United Technology Corporation, Hartford, CT (US)

( * ) Notice: Subject to any disclaimer, the term of this patent is extended or adjusted under 35 U.S.C. 154(b) by 713 days.

(21) Appl. No.: 12/953,688

(22) Filed: Nov. 24, 2010

(65) Prior Publication Data

US 2012/0128497 A1 May 24, 2012

(51) Int. Cl.

| | |
|---|---|
| ***F01D 9/04*** | (2006.01) |
| ***F04D 29/54*** | (2006.01) |
| ***F01D 5/20*** | (2006.01) |
| ***F01D 11/00*** | (2006.01) |
| ***F04D 29/02*** | (2006.01) |

(52) U.S. Cl.

CPC *F01D 9/041* (2013.01); *F01D 5/20* (2013.01); *F01D 11/001* (2013.01); *F04D 29/023* (2013.01); *F04D 29/542* (2013.01); *F04D 29/544* (2013.01); *F05D 2250/192* (2013.01); *F05D 2250/292* (2013.01); *F05D 2250/70* (2013.01)

(58) Field of Classification Search

CPC ..... F01D 5/187; F01D 5/20; F05B 2240/30
USPC ..... 415/174.4, 173.7; 416/185, 223 A, 228
See application file for complete search history.

(56) References Cited

U.S. PATENT DOCUMENTS

| | | | | |
|---|---|---|---|---|
| 899,319 | A * | 9/1908 | Parsons et al. | 415/173.5 |
| 2,995,294 | A * | 8/1961 | Warnken | 415/209.2 |
| 3,383,093 | A * | 5/1968 | Howald | 416/232 |
| 4,118,147 | A * | 10/1978 | Ellis | 416/230 |
| 4,874,290 | A | 10/1989 | Cang et al. | |
| 5,342,170 | A * | 8/1994 | Elvekjaer et al. | 415/192 |
| 5,476,363 | A * | 12/1995 | Freling et al. | 415/173.1 |
| 5,738,491 | A | 4/1998 | Lee et al. | |
| 5,794,338 | A * | 8/1998 | Bowden et al. | 29/889.1 |
| 6,179,556 | B1 | 1/2001 | Bunker | |
| 6,602,052 | B2 | 8/2003 | Liang | |
| 6,672,829 | B1 | 1/2004 | Cherry et al. | |

(Continued)

FOREIGN PATENT DOCUMENTS

| | | |
|---|---|---|
| EP | 1555392 | 7/2005 |
| EP | 1746185 | 1/2007 |

(Continued)

OTHER PUBLICATIONS

Alcoa Howmet, Integral Castings: Design to Cost While Improving Performance, 2001, published by Howmet Corporation. p. 1.*

(Continued)

*Primary Examiner* — Nathaniel Wiehe
*Assistant Examiner* — Kayla McCaffrey
(74) *Attorney, Agent, or Firm* — Carlson, Gaskey & Olds, P.C.

(57) ABSTRACT

A gas turbine engine stator segment has a shroud band and a plurality of blade sections. Each of the blade sections has a first section with a first thickness, second section with a second thickness and a fairing section transitioning between the first and second section. The second section thickness is less than the first section thickness.

20 Claims, 4 Drawing Sheets

(56) References Cited

U.S. PATENT DOCUMENTS

| | | | | |
|---|---|---|---|---|
| 6,761,539 | B2 * | 7/2004 | Cipelletti et al. | 416/228 |
| 6,991,427 | B2 * | 1/2006 | Scott | 415/209.3 |
| 7,029,235 | B2 * | 4/2006 | Liang | 416/92 |
| 7,241,108 | B2 * | 7/2007 | Lewis | 415/173.4 |
| 7,281,894 | B2 | 10/2007 | Lee et al. | |
| 7,513,749 | B2 * | 4/2009 | Duong et al. | 416/223 A |
| 7,726,937 | B2 | 6/2010 | Baumann et al. | |
| 2003/0041928 | A1 | 3/2003 | Spitsberg | |
| 2005/0238483 | A1 | 10/2005 | Guemmer | |
| 2008/0219835 | A1 * | 9/2008 | Freling et al. | 415/173.4 |

FOREIGN PATENT DOCUMENTS

| | | |
|---|---|---|
| EP | 1905952 | 4/2008 |
| EP | 1908857 | 4/2008 |
| EP | 2236642 | 10/2010 |
| EP | 2309097 | 4/2011 |
| WO | 0236844 | 5/2002 |
| WO | 2004010005 | 1/2004 |

OTHER PUBLICATIONS

European Search Report for European Patent Application No. 11190084.1 completed Jul. 24, 2013.

EP Search Reported dated Apr. 14, 2011.

Nijdam T J et al: "Combined pre-annealing and pre-oxidation treatment for the processing of thermal barrier coatings on NiCoCrAlY bond coatings." Surface and Coatings Technology, Elsevier, Amsterdam, NL, vol. 201, No. 7, Dec. 20, 2006, pp. 3894-3900, XP024995909.

* cited by examiner

TURBINE ENGINE COMPRESSOR STATOR

BACKGROUND

The present application is directed toward a gas turbine engine stator segment, and more particularly, toward a cast stator shroud band and stator blade.

Gas turbine engines, such as those commonly used in aircraft are typically segmented with the engine segments being isolated from each other with a seal. Dividing the segments are rotor/stator pairs that combine to form the seal. The rotor/stator seal arrangement allows rotation of an inner aperture to be passed between engine segments without compromising the integrity of the seal. One example seal configuration used in gas turbine engines is a blade seal. A blade seal uses contact between stator blades and rotors to create the seal. Use of a blade seal introduces friction between the stator blades and the rotor, thereby generating heat and wearing the stator blades. In order to reduce friction, the tip of the stator blade is often milled such that the tip is thinner and therefore has a lower contact surface area, leading to less friction and less heat.

SUMMARY

Disclosed is a stator segment having a shroud band, and a plurality of blades protruding radially inward from the shroud band, each of the blades is defined by a first section having a first thickness, a second section having a second thickness, and a faired section transitioning from the first section to the second section. The second thickness is less than the first thickness.

Also disclosed is a turbine engine assembly having a rotor extending radially outward from an inner aperture to an outer periphery, and a stator having a shroud band and a plurality of blades extending inward from the shroud band toward the inner aperture. Each of the blades is defined by a first section having a first thickness, a second section having a second thickness, and a faired section transitioning from the first section to the second section, with the second thickness being less than the first thickness.

Also disclosed is a method for creating a stator shroud band having a plurality of radially inward protruding blades. The method has the steps of: casting a single piece having a stator shroud and multiple radially inward protruding blades; and trimming a tip end of each of the protruding blades such that each tip end is a desired length.

BRIEF DESCRIPTION OF THE DRAWINGS

The disclosure can be further understood by reference to the following detailed description when considered in connection with the accompanying drawings wherein.

DETAILED DESCRIPTION

Figure 1:
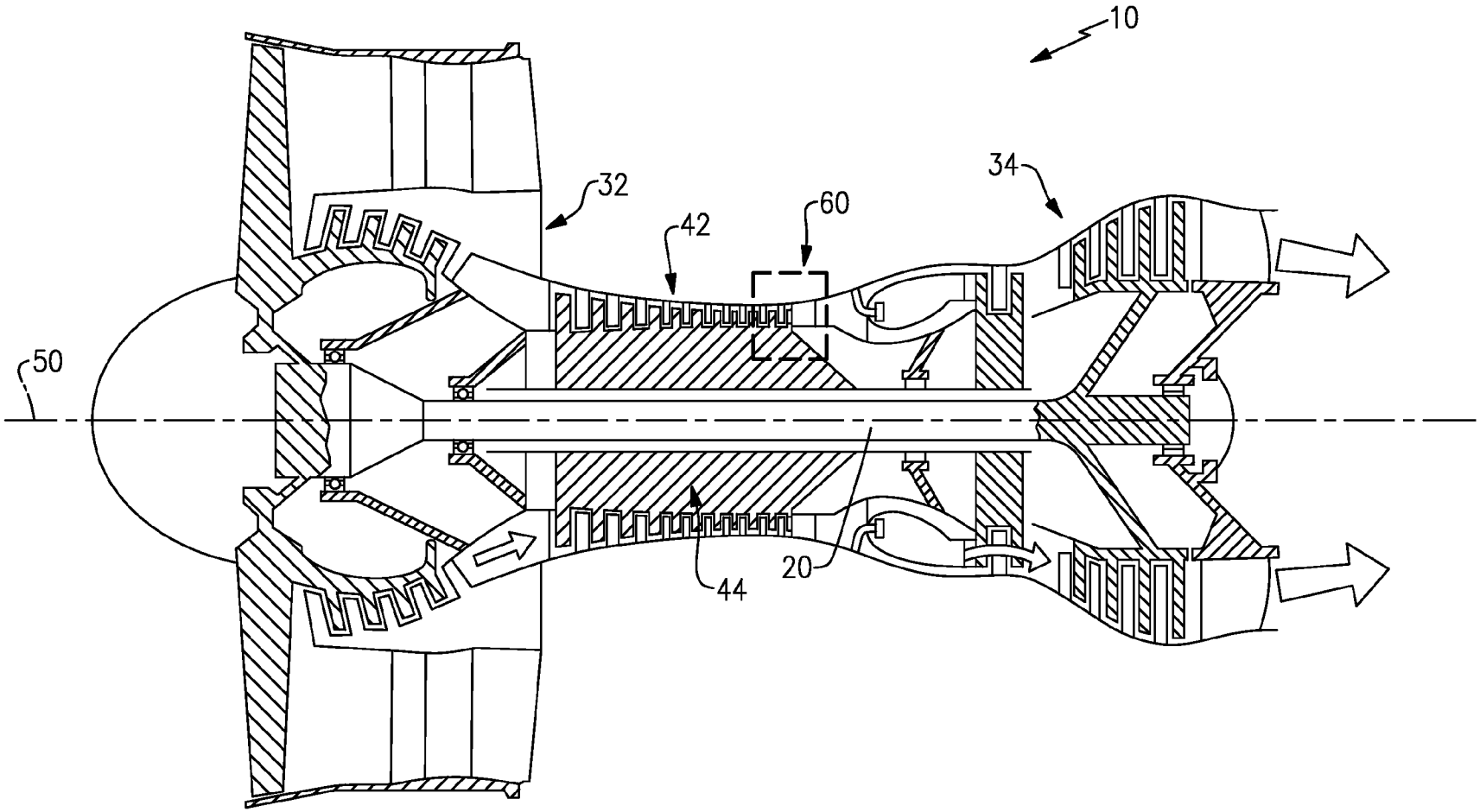
FIG. 1 is an illustration of an example turbine engine.
Figure 2:
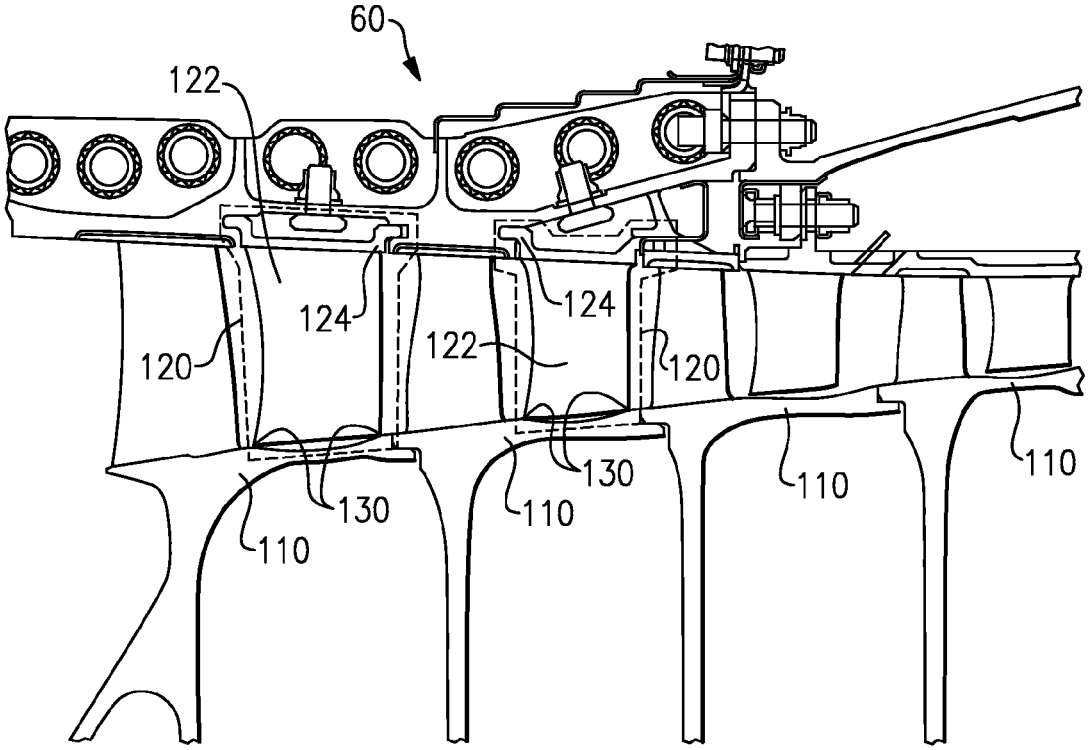
FIG. 2 is a sectional view of a blade seal portion of the example turbine engine of FIG. 1.
Figure 6:
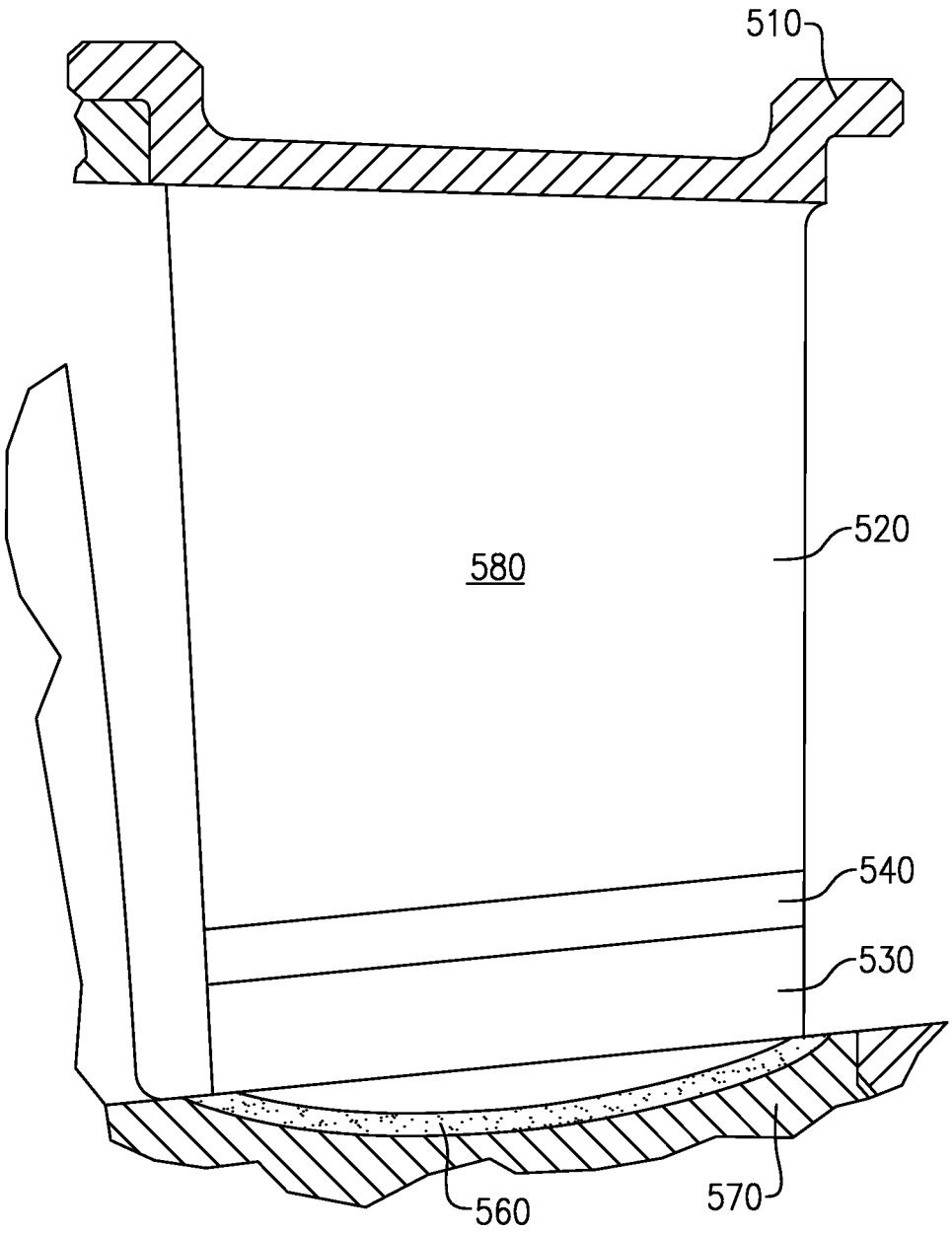
FIG. 6 is an end view of an example stator shroud band and stator blade in contact with a rotor.

FIG. 1 illustrates an example turbine engine 10 having an inner aperture 20. The inner aperture 20 transmits rotational movement through the turbine engine 10 to multiple engine sections 32, 34. The engine sections 32, 34 are isolated from each other with a stator 42 and a rotor 44 arranged in a blade seal configuration 60 according to known sealing techniques. The rotor 44 and the inner aperture 20 rotate about an axis 50. The blade seal configuration 60 can be seen in greater detail in FIG. 2, which is a sectional view of the blade seal configuration 60 of the turbine engine 10 of FIG. 1. The blade seal 60 is made up of multiple rotor disc 110 and stator segment 120 pairs. Each of the stator segments 120 has a blade component 122 and a stator shroud band component 124. During operation of the engine 10, the rotors 110 rotate about the axis 50 along with the inner aperture 20. The stator blades 122 contact the rotors 110 at a radially inward end 130, thereby creating a blade seal. An example configuration illustrating the contact between the stator blades 122 and the rotors 110 is illustrated in FIG. 6, and described below.

Figure 3:
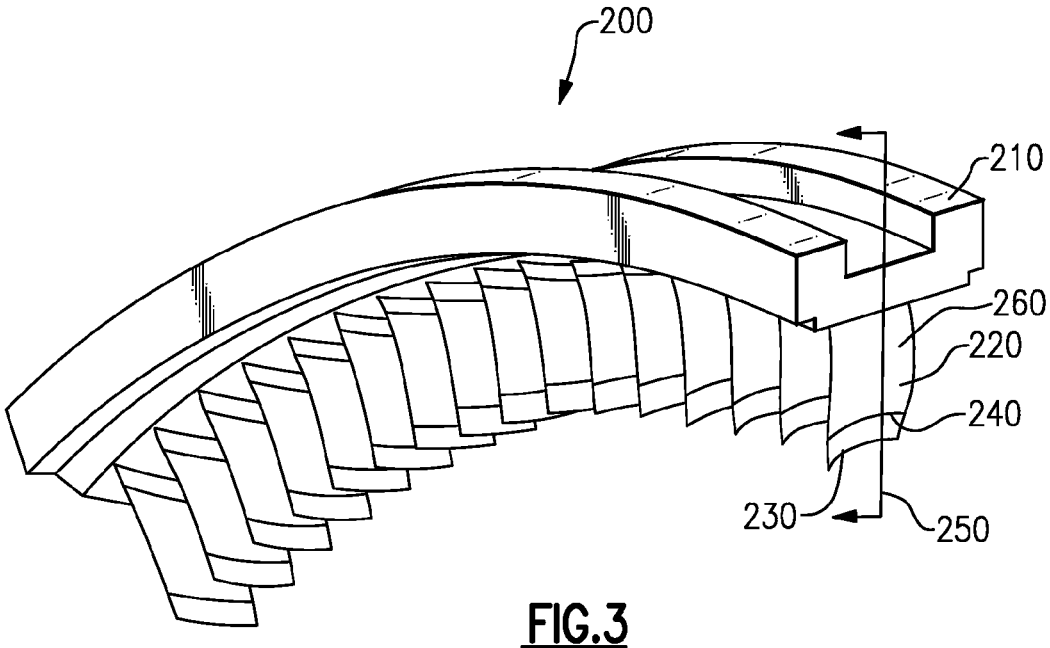
FIG. 3 is an isometric view of an example stator shroud band and stator blades.

An isometric view of an exemplary stator segment 200 is illustrated in FIG. 3. The stator segment 200 has a bowed shroud band 210 from which multiple stator blades 260 protrude radially inward. The stator blades 260 each are composed of a base section 220, which forms the majority of the blade 260, a tip end 230 for contacting the rotor 110 (illustrated in FIG. 2), and a fairing section 240 transitioning between the base section 220 and the tip end 230. The stator segment 200 is cast as a single piece resulting in a solid unit of both the blades 260 and the shroud band 210. The fairing section 240 causes the cast piece to be within acceptable variances by allowing a cast material to flow smoothly and evenly from the base section 220 of the mold into the tip section 230 of the mold. Even flow of the cast material reduces variance in the tip ends 230 of the finished stator segment 200 and ensures that the stator segment 200 falls within design tolerance.

Figure 4:
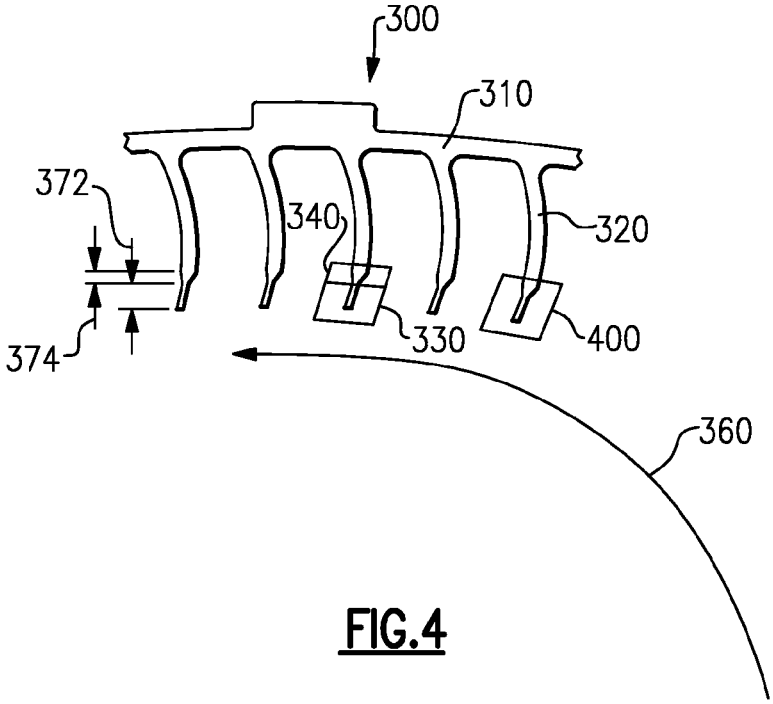
FIG. 4 is a side view of the example stator shroud band and stator blades of FIG. 3.

FIG. 4 illustrates a cross-sectional side view of the stator segment 200 of FIG. 3 along view line 250, with like numerals indicating like elements. Each of the stator blades includes a base section 320, a fairing section 340, and a tip end 330. Additionally indicated in FIG. 3, is an expected direction of rotation 360 of contacting rotor. The contacting rotor forms the other half of the blade seal 60 (illustrated in FIG. 1). The blade tip ends 330 have a radial tip length 372 and are angled relative to the rotor to allow for the tip ends 330 to flex with the expected rotation of the rotor. The material used to cast the stator segment 300, along with the angle of the blade tips 330 allows the tips 330 to flex either with the rotation of the rotor, when the rotor is rotating in an expected direction 360 or in a direction opposing the expected direction 360 of rotation of the rotor when the rotor is rotating a reverse direction. Furthermore, each of the fairing sections has a radial fairing length 374.

Figure 5:
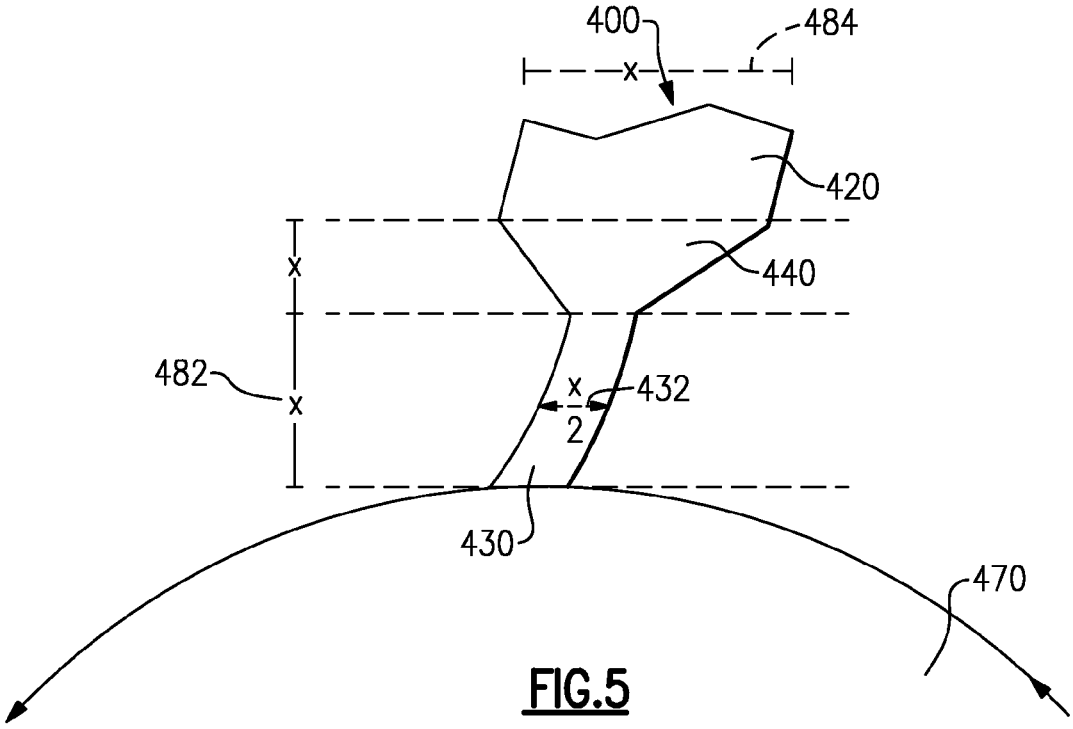
FIG. 5 is a sectional view of a fairing section and tip end of an example stator blade.

FIG. 5 illustrates a single blade tip 400 in contact with a rotating member 470, which is not drawn to scale with certain features exaggerated for explanation purposes. The illustrated tip end 430 has a radial tip end length 482 of X relative to a base end 420 width 484 of X. This results in a ratio of approximately 1:1 radial tip end length 482 to base end width 484. Actual implementations include variance and therefore do not have the exact ratio described above. For this reason, a thickness ratio within the range of 0.5:1 to 1.5:1 falls within the present disclosure. Additionally, the tip end 430 has a width 432 of ½X in the illustrated example, thereby improving the performance of the seal. It is understood that the tip end 430 width 432 could fall anywhere within the range of ¼X to ¾X in an alternate embodiment. The base length "X" is determined based on the width of the blade at the base end 420. Alternately, a value X can be used for the tip end 430 length and the fairing section 440 that is proportional to the base end width 484 without being identical to the base end width 484.

FIG. 6 illustrates a contextual drawing of a stator shroud band 510 and blade 580 relative to a rotor 570. Included on the rotor 570 is a stator blade contact pad 560. The contact pad 560 provides a contact surface for the rotor 570/stator 580 pair that allows for controlled wear of the tip end 530 and the contact pad 560 as a result of friction. The contact pad 560 is constructed of any suitable material that demonstrates desired properties relative to the material of the stator blade 540. In one example, the contact pad 560 is constructed out of a material that is abrasive to the tip end 530 of the stator blade 540 thereby causing the stator blade 540 to wear during rotation. In another example, the contact pad 560 is abratable relative to the stator blade 540, thereby causing the contact pad 560 to wear, during rotation.

In order to create the above described stator segment 580, the stator segment 580, including the stator shroud band 510 and the stator blades, is cast as a single piece. The inclusion of the fairing section 540 of the blade allows the cast material to flow evenly into the section of the mold corresponding to the tip end 530 from the section of the mold corresponding to a blade section 520, thereby reducing variance of the thickness of the tip end 530 as described above. In addition to the fairing section 540, the tip ends 530 are cast at a length longer than the desired length. The excess length of the tip ends 530 is then cut off using any known cutting technique, resulting in a desired tip end 530 length. The excess length of the cast tip end 530 reduces variance of the tip end 530 thickness by allowing the cast material to be drawn further into the tip of the mold and ensuring an even thickness at least to the desired length of the tip end. Aside from cutting the tip end 530 to the desired length, the stator segment 580 does not undergo any milling or alterations after it is cast.

The above example illustrations show a partial ring stator segment that is combined with other identical stator segments 580 to form a full stator ring. However, it is understood that the stator segment 580 can be cast as a full stator ring rather than the illustrated partial segment and fall within the above disclosure.

Although an example has been disclosed, a worker of ordinary skill in this art would recognize that certain modifications would come within the scope of the claims. For that reason, the following claims should be studied to determine their true scope and content.

What is claimed is:

1. A blade seal comprising:

A stator segment including a shroud band;

a plurality of blades protruding radially inward from said shroud band, each of said blades defined by a first section connected to said shroud band at a first end and having a first width and a first length, a squealer tip section having a second width and a second length, the second width being constant, and a faired section connecting said first section and said squealer tip section having a third length and width transitioning from said first section to said squealer tip section, said second width being less than said first width;

said fairing section comprises a fairing on a first engine segment side of said blade and a fairing on a second engine segment side of said blade;

wherein said fairing on said first engine segment side of said blade and said fairing on said second engine segment side of said blade are faired in opposing directions; and wherein at least one of said faring section on said first engine segment side of said blade and said fairing section on said second engine segment side of said blade is at least partially linear; and a rotor radially inward of the stator segment, wherein a radially inward surface of each squealer tip contacts said rotor.

2. The blade seal of claim 1, wherein a ratio of squealer tip section length to first section width is approximately within the ranges of 0.5:1 to 1.5:1.

3. The blade seal of claim 1, wherein each of said squealer tip sections is angled relative to an adjacent rotor such that said squealer tip sections flex in a direction of said adjacent rotors rotation.

4. The blade seal of claim 1, wherein said shroud band is a complete ring.

5. The blade seal of claim 1, wherein said shroud band is a partial ring, such that a plurality of said stator segments can be combined to form a complete ring.

6. The blade seal of claim 1, wherein said second and said third length are approximately equal, and wherein said second length is approximately equal said first width.

7. The blade seal of claim 1, wherein said stator segment comprises a single cast piece.

8. The blade seal of claim 1, wherein a ratio of said second width to said first width is within the range of ¼:1 to ¾:1.

9. The blade seal of claim 8, wherein said ratio of said second width to said first width is approximately ½:1.

10. The blade seal of claim 1, wherein said first section, said second section, and said faired section are integrally cast of a single uniform material.

11. The blade seal of claim 1, wherein said first length, said second length, and said third length are each defined along a respective radial direction relative to the shroud band.

12. The blade seal of claim 1, wherein said first width is normal to said first length and said second width is normal to said second length.

13. The blade seal of claim 1, wherein the rotor further comprises a contact pad and wherein said contact between the rotor and each squealer tip is at said contact pad.

14. The blade seal of claim 13, wherein the contact pad is abatable relative to the squealer tip.

15. The blade seal of claim 13, wherein the contact pad is abrasive relative to the squealer tip.

16. A turbine engine assembly comprising:

a rotor extending radially outward from an inner aperture to an outer periphery; and a stator having a shroud band and a plurality of blades extending inward from said shroud band toward said inner aperture, each of said blades defined by a first section connected to said shroud band at a first end and having a first width and a first length, a squealer tip section having a second width and a second length, wherein the second width is constant, and a faired section connecting said first section and said squealer tip section having a third length and transitioning from said first section to said squealer tip section, said second width being less than said first width, a radially inward end of said squealer tip section contacting a surface of said rotor;

said fairing section comprises a fairing on a first engine segment side of said blade and a fairing on a second engine segment side of said blade;

wherein said fairing on said first engine segment side of said blade and said fairing on said second engine segment side of said blade are faired in opposing directions; and wherein at least one of said faring section on said first engine segment side of said blade and said fairing section on said second engine segment side of said blade is at least partially linear.

17. The turbine engine assembly of claim 16, wherein said stator comprises a plurality of stator segments.

18. The turbine engine assembly of claim 16, wherein said contact surface of said rotor is abrasive relative to said plurality of blades.

19. The turbine engine assembly of claim 16, wherein said contact surface of said rotor is abradable relative to said plurality of blades.

20. The turbine engine assembly of claim 16, wherein said blades are bowed such that said radially inward end of each squealer tip section contacts said contact surface at an angle other than 90°.

* * * * *

UNITED STATES PATENT AND TRADEMARK OFFICE

CERTIFICATE OF CORRECTION

PATENT NO. : 9,181,814 B2
APPLICATION NO. : 12/953688
DATED : November 10, 2015
INVENTOR(S) : Hope C. Rowley et al.

It is certified that error appears in the above-identified patent and that said Letters Patent is hereby corrected as shown below:

IN THE SPECIFICATION:

Column 3, line 15; delete “abratable” and replace with --abradable--

IN THE CLAIMS:

In claim 1, column 4, line 1; delete “faring” and replace with --fairing--

In claim 14, column 4, line 42; delete “abatable” and replace with --abradable--

In claim 16, column 5, line 1; delete “faring” and replace with --fairing--

Signed and Sealed this
Eighth Day of March, 2016

Michelle K. Lee

Michelle K. Lee
*Director of the United States Patent and Trademark Office*